United States Patent [19]

Ring et al.

[11] 4,007,083

[45] Feb. 8, 1977

[54] METHOD FOR FORMING WET-LAID NON-WOVEN WEBS

[75] Inventors: Michael Ring, Warwick, N.Y.; Madhu P. Godsay, New Delhi, India; Roy S. Swenson, Central Valley, N.Y.; Joseph N. Kent, Lewisburg, Pa.

[73] Assignee: International Paper Company, New York, N.Y.

[22] Filed: Dec. 26, 1973

[21] Appl. No.: 427,482

[52] U.S. Cl. ..... 162/101; 162/146; 162/157 R; 162/158; 162/184; 162/190; 260/29.6 XA

[51] Int. Cl.[2] ..... D21D 3/00

[58] Field of Search ..... 162/100, 101, 184, 186, 162/146, 204, 157 R, 157 C, 190, 158 N, 158 R, 168 R, 135; 252/357; 118/414; 106/122; 427/385, 390; 260/29.6 XA

[56] References Cited

UNITED STATES PATENTS

| | | | |
|---|---|---|---|
| 2,857,370 | 10/1958 | Sundberg | 260/401 |
| 3,013,035 | 12/1961 | Huber et al. | 260/401 |
| 3,057,889 | 10/1962 | Schenck | 260/401 |
| 3,067,087 | 12/1962 | Gorski et al. | 162/158 |
| 3,115,438 | 12/1963 | Randall | 162/184 |
| 3,187,026 | 6/1965 | Klass | 260/401 |
| 3,722,469 | 3/1973 | Bartley et al. | 118/414 |
| 3,794,557 | 2/1974 | Harmon | 162/157 C |

OTHER PUBLICATIONS

Casey, "Pulp & Paper" 2nd ed., vol. 2 (1960) p. 766.

Calkin, "Modern Pulp & Paper Making," 3rd ed. (1957) p. 312.

Battista, "Syn. Fibers in Papermaking" (1964), p. 269–282.

*Primary Examiner*—S. Leon Bashore
*Assistant Examiner*—Peter Chin
*Attorney, Agent, or Firm*—John A. Howson

[57] ABSTRACT

A method of producing textile-like non-woven essentially binderless webs from fiber furnishes at least about 70% of which comprise man made non-fibrillatable low denier fibers having no large area flat surfaces and which are at least about ¼ inch in length with a length to diameter ratio of between about 400:1 and 700:1. The method includes a wet laying system in which sufficient wetting agent is added to the water used in dispersing the fibers to wet the fibers completely and reduce the surface tension of the water to between about 30–35 dynes. It also includes agitating the dispersion vigorously to create tumbling water surface conditions in which up to, but less than about 4% by volumeof air is entrained in the water in the form of tiny air bubbles to create a water/air emulsion in which the fibers are dispersed without generating any substantial amount of surface foam. A viscosity modifier in the form of a natural or synthetic gum is also added to stabilize the emulsion and help prevent the dispersed fibers from reflocculating.

15 Claims, No Drawings

METHOD FOR FORMING WET-LAID NON-WOVEN WEBS

BACKGROUND OF THE INVENTION

This invention relates to a process for producing textile-like non-woven sheet material and more particularly to a process for forming uniform binderless webs of synthetic fibers from a water dispersion using a conventional moving wire screen.

Though dry-laid and spun-bonded non-wovens made of synthetic fibers are known, heretofore, it has been difficult to form uniform water-laid webs from non-fibrillatable man made fibers, particularly those which are hydrophobic, have a low denier, and are relatively long (i.e., have a length greater than about ¼ inch and a length to diameter ratio of between about 400:1 and 700:1) or have round or non-flat surface characteristics. Crimped fibers are also particularly difficult to form into uniform water-laid webs.

The difficulty in forming such webs from liquid phase dispersions lies principally in achieving good web formation on a moving wire screen and in transferring the web from the screen without its being torn or pulled apart.

Uniform web formation is hard to obtain, because it is difficult to disperse relatively long man made non-fibrillatable fibers in water and hard to maintain them well dispersed without undesirable flocculations. It is also difficult to form such webs uniformly, because water drains through them so quickly it is not possible to use shake mechanisms such as are common in the making of paper for achieving uniform formation.

It is known that in order to disperse fibers in water, each fiber has to be well wetted with the water. In hydrophilic fibers, such as viscose rayon, acetate rayon, cellulose acetate & polyvinyl acetate, wetting the fibers is not much of a problem. Wetting hydrophobic fibers made from polymers such as polyamides, polyesters, polyolefins and the like, however, is a problem since such fibers do not wet easily. Thus, either a wetting agent in the water or some surface coating or pretreatment of a wetting agent on the fibers, or both, is necessary. However, since most wetting agents, or surfactants, are also good foam generating agents, when present in amounts adequate to wet the fibers satisfactorily, they tend to create copious quantities of unwanted foam even under gentle agitation conditions. This in turn tends to float the fibers out of the dispersion.

Further, we have found that, when defoaming agents are added to dispersions of such fibers, the fibers tend to flocculate making the formation of a uniform web more difficult.

It is also known to use wetting agents, in wetlaying systems, which are not good foam generating agents, to disperse non-fibrillatable short synthetic fibers of 10 mm or less in length and having a length to diameter ratio within a range of from about 3:1 to 10:1. However, even with intense agitation such agents have not been able to satisfactorily disperse longer synethic fibers with length to diameter ratios of between about 400:1 and 700:1.

In addition, it has been observed that, when the viscosity of the water is increased in a water dispersion system the rate of fiber reflocculation is reduced, thus improving web or sheet formation. Thickeners such as natural and synthetic gums have been used as viscosity modifiers to raise the viscosity of water for this purpose.

To increase initial wet web strength, in some instances, hydrated (fibrillated) wood or other natural fibers and even fibrillated synthetic fibers have been used in non-fibrillatable synthetic fiber furnishes to hold the web together while being transferred from a moving forming wire across unsupported draws to wet presses or other treating equipment where a binder is added to hold the fibers together more permanently. In such a web, before the addition of any adhesive, the web is held together in part by the mechanical interlocking of the fibrillated fibers.

Other techniques for increasing the initial wet strength of man made non-fibrillatable fiber sheet materials include coating or encapsulating short natural fibers with latex polymer binders precipitated on the fibers in the water before forming the sheet. These binders hold the sheet together and allow its continuous removal from the forming wire without breaking or tearing.

The use of precipitated latex polymers tend to produce softer and more textile like properties in the web than in normal papermaking processes, but it is a more expensive technique and has the added disadvantage of being tacky, thus making it difficult to maintain clean and non-tacky machine conditions. Further, the use of fibrillated natural or synthetic fibers as part of the furnish, though advantageous in the production of synthetic paper, is not desired in wet-laid non-wovens for textile use. These fibers tend to make the material stiff and non-porous, properties which are not desired in non-wovens intended for use as replacement fabrics for textiles.

One additional technique, namely that disclosed in U.S. Pat. No. 3,223,581, has also been used to hold paperlike sheets of synthetic polymer fibers together. This technique involves no binders, but a very careful control of the amount of water in the web as it is transferred from the forming wire. It also requires that the fibers forming the web have essentially smooth and flat or planar surfaces to provide large areas of surface contact between the fibers. Only with these conditions does the invention of that disclosure indicate how to give the web sufficient initial wet strength to hold together without binder material while being transferred from the forming machine without being torn or pulled apart. One disadvantage of the process of the U.S. Pat. No. 3,223,581 is that it is limited to using fibers having essentially smooth, flat surfaces for providing large area surface contact between the fibers forming the sheet. In addition, such fibers produce relatively dense, stiff and "papery" sheets which are undesirable in non-wovens for textile use. Round and other fibers having no flat surfaces will not work in that process. They are, however, usable in the process according to the present invention.

Further, although it is possible to disperse non-fibrillatable hydrophobic synthetic fibers as disclosed in U.S. Pat. No. 3,007,840 and British Patent No. 1,129,757 by means of a substantially liquid phase free thixotropic foam as the dispersing medium and to form a web from the dispersion, no one, heretofore, has been able to accomplish satisfactory dispersion and web formation of such fibers using conventional non-woven water-laying techniques.

It is therefore one object of this invention to provide a new and improved method for producing non-woven sheet material webs suitable for use in textiles or as textile replacements.

Another object of the invention is to provide a novel process for forming such material from man made non-fibrillatable fibers or from a mixture of such fibers with non-fibrillated natural or synthetic pulp or flock fibers.

Still another object of the invention is to provide a method for forming such material of fibers having virtually no flat surfaces from an aqueous slurry by conventional wetlaid non-woven web forming techniques.

Yet another object of the invention is to provide webs which are self supporting in the wet or never dried state (i.e., with enough initial wet web strength to enable the web to be drawn off the forming wire and through conventional wet pressing and treatment equipment) from synthetic fibers having no large flat surface areas and without using either fibrillated fibers in the furnish or binders at the wet end to hold the web together.

A further object of the invention is to provide a method for forming such sheet material using a novel method for uniformly dispersing the fibers in water.

A still further object of the invention is to provide a method having the above characteristics in which the already dispersed fibers are substantially prevented from reflocculating.

Further, other and additional objects and advantages of the invention will become apparent from the summary and detailed description which follows, as well as from the appended claims.

SUMMARY OF THE INVENTION

The process according to the invention comprises forming a substantially binder-free aqueous dispersion of non-fibrillated fibers, at least a majority of which are man made non-fibrillatable fibers ¼-inch or more in length, in a water/air emulsion in which the volume of air does not exceed about 4% that of the water and forming a coherent web from this dispersion by draining it through a web forming wire.

Though most fiber furnishes dispersed in the emulsion by this process include about 70% or more nonfibrillatable man made fibers together with up to about 30% short non-hydrated natural fibers, the furnish may comprise 100% synthetic fibers such as polyester, or 100% rayon fibers such as viscose rayon. In most non-woven webs made according to the process, however, a proportion of short (i.e., less than ¼-inch long) low denier flock or pulp fibers such as non-hydrated natural fibers or non-fibrillatable man made fibers are used as part of the furnish to help disperse the longer fibers and keep them apart in the water.

The water/air emulsion is produced, according to the invention, by dissolving one or more wetting agents in the water to wet the fibers completely and to reduce the surface tension of the water to the point where, by agitating the water vigorously enough to create tumbling vortex-free water surface conditions, air will be entrained in it in the form of tiny air bubbles. When properly controlled, the emulsion is formed without creating any substantial amount of surface foam.

The turbulence conditions present in a conventional paper maker's pulper which has been provided with vertical wall fins to prevent vortexing in the liquid are generally satisfactory for the creation of a fiber dispersion water/air emulsion according to the process of this invention. The surfactants used normally comprise about 0.007% to about 0.03% by weight of the water, depending on the level of agitation used and the nature of the fibers to be dispersed. In addition, using conventional measuring techniques discussed further hereinafter, these agents are preferably chosen to give the water/wetting agent solution a low interfacial tension (i.e., less than about 19 dynes) and a contact angle of between about 50° and 58° with a smooth disc of the same polymer material from which the man made non-fibrillatable fibers are made.

In dispersing some hydrophilic fibers, where the agitation level is low enough, good foam generating surfactants alone can be used. For others, including most hydrophobic fibers, where the agitation must be more vigorous, to break up the knits and bundles into the individual fibers, a combination of low foam generating and good foam generating surfactants may be required. In either case, the amount of surfactant needed for optimum conditions is enough to lower the surface tension of the water to a range of between about 30–35 dynes. When the proper surfactants are used and the surface tension has been lowered to within this range and the mixture is agitated to create vortex-free tumbling surface conditions, the required water/air emulsion will be formed without any substantial amount of surface foam. An emulsion according to this invention tends to have a milky white appearance and must be maintained in a steady state (i.e., any air bubbles escaping from the liquid must be replaced by others) to keep the air entrained in the dispersion. If the level of the agitation is allowed to fall, some of the air bubbles will float out of the suspension and carry fibers with them.

To help stabilize the emulsion and to help keep the dispersed fibers apart, it is advisable to add a small quantity of a natural or synthetic gum to the mixture to slow down the movement of air bubbles out of suspension. These gums preferably comprise natural or synthetic essentially anionic long chain polymers with a ropey or stringy texture (i.e., with a coiled molecular structure). By slowing down the movement of the tiny air bubbles out of suspension, the level of agitation required to form and maintain the emulsion in a steady state is less than it otherwise would be. By making the emulsion easier to maintain it is easier to handle. Under normal conditions between about 0.0009% and about 0.006% of a natural or synthetic gum by weight of the water is added to aid in maintaining the emulsion. If desired, it may be added initially with the surfactants. It can also be added later after the dispersion is formed. In any event, it should be in the dispersion before it is transferred out of the stock preparation tank. If too much gum is added, the emulsion is difficult to form or maintain. If too little is used, the emulsion tends to be unstable and break down.

Though the precise mechanism of the process is not fully understood, it is believed that using a high shear action to break up the knits and bundles in the synthetic or man made fibers into individual fibers in the water in a controlled manner creates a vigorous agitation which also entrains air in the form of tiny bubbles in the dispersion, without generating any substantial amount of surface foam. The tiny air bubbles in the emulsion appear to act as buffers which help to keep the longer dispersed fibers apart. As long as the emulsion is maintained in a relatively steady state, it is believed the bubbles continue to serve this function until the web is formed.

As in conventional wet-laid non-woven processes, the process according to this invention requires the use of white water to dilute the consistency of the fiber dispersion before forming the web. Preferably, the dispersion will be formed at a consistency of between about 0.35–2% and then diluted before web formation to between about 0.006% and 0.01% based on the bone dry weight of the fibers. In addition, in order to facilitate diluting the initial dispersion without impeding the formation of a uniform web, it is necessary to form the white water into a water/air emulsion similar to the one in the fiber dispersion. Accordingly, the surface tension of the white water should also be reduced to a range of between about 30–35 dynes. Further, when starting up the process an appropriate amount of the natural or synthetic gum should be added to the white water. Though not needed for some fiber furnishes, it improves the maintainability of the white water/air emulsion and facilitates mixing the fiber dispersion in the white water without flocculating the fibers.

Because of the tendency of the tiny air bubbles in the white water system to float out of suspension, it is important to keep the white water in a constant state of agitation to keep the air entrained in it. When the surface tension of the water is in the 30–35 dynes range, air is normally entrained in the water as it passes through the forming wire. An example of a wet-laying headbox, inclined forming wire and suction box arrangement usable in this process is disclosed in U.S. Pat. No. 3,764,465. In pumping the water back to the wire where the web is formed, it is important, as far as possible, to keep the water agitated so the tiny air bubbles remain in suspension. If this is done, the white water emulsion should remain in a steady state. Increasing the white water emulsion flow rate may help achieve this result. Low surface tension water drains so quickly through synthetic fiber furnishes in any case, that increased flow rates may also help achieve good web formation.

Naturally, instead of preparing the initial fiber dispersion with fresh water, white water, which has already been modified with surfactant material and, if desired, a natural or synthetic gum, may be used in place of fresh water. If this is done, the amount of wetting agent or gum added to the dispersion, if any, will depend on the types and characteristics of the fibers in the furnish being formed into a web.

The whole process of forming and maintaining the liquid/air emulsion conditions in the dispersion system and in the white water system is aided by using water having a temperature of above 70° F. for both systems and preferably by maintaining it at about 80° F. The precise pH of the water is not critical, but a pH of about 7 works satisfactorily. If temperatures cooler than about 70° F. are used, the formation and maintenance of the water/air emulsion has been found to take longer and to be more difficult.

Because the web is formed in a substantially binder free condition, it is very tender and easy to pull apart or tear. Accordingly, a primary binder material in the form of a high solids latex foam with a density of between about 25 and 150 grams per liter is applied to the web as a primary binder after it is removed from the forming wire and before it is fully dried. The precise characteristics of the binder are chosen according to the desired characteristics of the finished sheet material. In some instances, it may be desirable to further treat the finished material with additional binder or other treatments to achieve the desired characteristics.

DETAILED DESCRIPTION

The process according to the invention involves dispersing fibers in a water/air emulsion having a total volume of air of less than about 4% (preferably between about 2% to 2.5%) that of the water. This process is particularly useful in dispersing low denier synthetic fibers longer than about ¼ inch and having no large flat surface areas.

The following table illustrates preferred denier and lengths for the straight fiber type indicated:

| Denier | Fiber Type | Fiber Length (Inches) |
|---|---|---|
| 1.5 | Polyester<br>Viscose Rayon<br>Nylon | ¼ |
| 3.0 | Polyester<br>Viscose Rayon<br>Nylon | ½ |
| 6.0 | Polyester<br>Viscose Rayon<br>Nylon | ¾ |
| 15.0 | Nylon<br>Polyester | 1 |
| 15.0 | Nylon<br>Polyester | 1–⅛ |

In almost all non-woven sheets suitable for textile use, fibers of more than one length and/or more than one type are blended and together give the sheet its drape, hand, opacity and other characteristic qualities. For the best textile-like qualities the majority of fibers in the furnish should be man made non-fibrillatable fibers with no large area flat surfaces and should be at least ¼ inch or more in length. As previously suggested in the Summary of the Invention, the remainder of the fibers can be shorter, non-fibrillated natural or synthetic pulp fibers or flock fibers, or a combination of these.

Dispersing all but the very long fibers (i.e., those over ¾ inches in length) is most easily accomplished in a hydropulper or some other stock preparation tank capable of subjecting the fibers to high shear agitation to break up the knits and bundles which tend to be more prevalent in low denier hydrophobic fibers. Naturally, hydrophilic fibers such as viscose rayon are more easily wetted and thus do not require the degree of high sheer agitation needed to disperse hydrophobic fibers. Neither do they require the amount of surfactant needed by hydrophobic fibers.

One satisfactory apparatus for accomplishing fiber separation of hydrophobic fibers is a pulper having a Volkes type rotor with four vertical tub vanes. The rotor preferably rotates above a bedplate which is perforated with holes both below the rotor and radially beyond the rotor's periphery to discharge the stock after the pulper has done its work. The size of the holes governs the length of fibers dispersible in the pulper. The holes should be larger in diameter than the longest length of fiber to be dispersed. It may also be useful to have the holes in the bedplate under the rotor, of smaller diameter than the others radially outwardly of them.

The tank itself should be provided with 3–4 or more smooth triangular vertical wall fins, the apices of which extend radially inwardly sufficiently to prevent a vortex from forming in the fiber/water/emulsion mixture when the rotor is turned on. Energy input to the rotor is satisfactory if for each horsepower of input there are between about $1.6 \times 10^{-3}$ to $9 \times 10^{-3}$ pounds of fibers per cubic foot of solution.

Other types of mixing equipment, such as a sloping bottom stock preparation tank with a side entry impeller, may also be used. Since this type of tank generally provides less severe agitation than a pulper, it is better for dispersing hydrophilic fibers than for hydrophobic fibers. For example, a 1500 gallon capacity, 80 inch diameter, 5 foot deep stock preparation tank with a 17½ inch diameter 3 bladed open impeller having about a 45° to 60° pitch with the impeller extending about 22 inches into the tank and the impeller shaft lying about 1.5 feet from the tank's circumferential bottom edge is satisfactory when the impeller is adapted to rotate at between about 20 and 718 r.p.m. depending on the level of stock in the tank and the fiber type being dispersed. Bottom or top entry impeller stock tanks are less satisfactory, because they tend to create a vortex in the slurry. In addition, in top entry impeller equipment the longer fibers tend to twist around the impeller shaft and cause flocks in the dispersion.

In some cases hydrophobic fibers, such as those made from polyester, require additional surfactants to be added to the stock preparation tank beyond those present in the white water to ensure the proper range of surface tension for adequate fiber wetting. In addition, we have found that, if the surface tension gets substantially above 35 dynes (for example, as high as about 40 dynes), a water/air emulsion according to the invention cannot be formed or maintained.

Further, while the measurement of surface tension is a good process control tool, as suggested in the summary herein, selection of the precise surfactants to be used with particular fibers can best be made by measuring the contact angle and interfacial tension characteristics of a solution of the agent with pure flat smooth surface specimens of the polymers from which the fibers are made. The interfacial tension (Niejal) of a wetting agent solution can be measured by a standard known procedure using a Du Nuoy Tensionmeter. Using this equipment we have found that interfacial tensions of about 19 dynes or less are the most suitable.

Contact angle measurements can be made by stripping the fibers of any surface pre-treatment finish that may be on them and forming a smooth disc from the cleaned fibers. This may be done by grinding the cleaned fibers through a Wiley mill, first with a 20 mesh screen and then with a 40 mesh screen. Discs of the polymer may then be prepared using a model C Carver press with a polished mirror finish stainless steel disc by pressing the ground fibers against the disc at about 20,000 psi for about 15 seconds. The contact angle measurements can then be made using a NRL C.A. Goniometer model A-100 with a microsyringe for dispensing 0.01 ml. of the water/surfactant solution to be tested onto the polymer disc through a 22 or 23 gauge needle. The contact angle is the angle between the plane of the polymer disc and a tangent to the 0.01 ml. drop of liquid on the disc through its point of contact with the disc and is measured after the liquid applying needle has been removed from the drop. Taking an average of 10 readings using this technique, the contact angle of any given water/surfactant solution can be reasonably accurately arrived at.

We have found that good foam generating wetting agents of the alkylaryl polyether alcohol type (octylphenol series) work satisfactorily with some fibers when used with appropriate agitation conditions. Rohm & Haas makes these products under the trade name Triton, for example Triton X-100 and Triton X-114. Both these surfactants are condensation products of ethylene oxide with alkylphenol. Some create less foam than others and hence can be used when somewhat more vigorous high shear agitation is required to break up the fiber bundles. When even more vigorous agitation is required, one of these surfactants may also be used in combination with a low foam generating surfactant such as an alkyl taurate having the formula $$C_{15}H_{31}-\overset{\overset{\displaystyle O}{\|}}{C}-\overset{\overset{\displaystyle C_6H_{11}}{|}}{N}-CH_2-CH_2SO_3^-Na^+$$

The precise amount and combination of these wetting agents to use may vary from one machine system to another depending on the degree of agitation provided in the hydropulper or stock preparation tank and how much wetting agent it takes to adequately wet the fibers and reduce the surface tension of the water to between about 30 to 35 dynes.

The amount of wetting agent required to make the emulsion in the stock preparation tank also depends in part on the nature of the surface pre-coating if any which is present on the fibers purchased from the manufacturer. Dupont polyester fibers, for example, are generally sold with a hydrophilic coating of wetting agent on them. Fibers of other manufacturers usually also have coatings, but the chemical make up of each manufacturer's coating is generally different. Some fibers are even sold with hydrophobic coatings. Naturally, the precise coating on the fiber has to be taken into account in determining the amount of wetting agent to add to the dispersion water.

As previously indicated, the water/air emulsion can be stabilized by the addition of a natural or synthetic gum to the dispersion and to the white water. A deacetylated polysaccharide such a Ropy Karaya Gum is an example of a natural gum which is usable in the process according to the invention, but in the presence of iron in the water it has the disadvantage of tending to tint the resulting sheet with a brownish color.

Synthetic gums such as long chain polyacrylamides and cross-linked polyacrylamides may also be used. Generally, those having a molecular weight of at least about 750,000 and up to about 6,000,000 are preferred. These are water soluble polymers made from the polymerization of acrylamide. They normally have a hydrolysis of between about 20–40%. Combinations of any of these natural and synthetic gums may also be used. The synthetic gums have the advantage of not discoloring the sheet if there is iron in the water.

At the levels used in the process according to this invention, none of these substances are binders or adhesives at the wet end in the normal sense of these words, but it is believed that they do help hold the sheet together as it comes off the forming wire and is transferred to another station for further treatment. The precise mechanism of how a 100% hydrophobic fiber sheet is held together is not fully understood, but it is believed to be accomplished by water menisci between the fibers which come in contact with one another as the web is formed on the wire. Though most of the water is drained through the wire as the web is formed, small amounts are left in the sheet in the form of a water meniscus at each fiber to fiber crossover or contact point. The low surface tension of the water helps wet the fibers completely enough to create these menisci. It is believed that though the fiber holding ability of each water meniscus probably decreases as the surface tension of the water decreases, the sheet holds together better because the fibers are more completely wetted and many more water menisci are formed at fiber contact points in the sheet than would be formed in water having a higher surface tension. Hence, the sheet has a greater initial wet web strength. Naturally, if the fibers in the sheet had large flat surface areas for contacting other fibers, they would be held together more tightly than with round or non-flat surfaced fibers, but the process according to the invention works with round and other non-flat surfaced fibers as well. Further, where the fiber furnish includes a proportion of natural fibers, even though not hydrated, these fibers do appear to provide a network to help improve the initial wet web strength.

It is believed that the presence of natural or synthetic gums in the water also helps hold the sheet together by gum's tendency to increase the strength of the water menisci between the fibers. As it comes off the forming wire, a sheet made according to the process of this invention has no binder in it. It does have a water content of about 80% based on the dry weight of the fibers. From the forming wire, the web is transferred to a wet press where it is consolidated and its moisture content reduced to about 65%. Then the web is transferred to a station where a latex binder is applied to bond the fibers together. If no binder were applied to the sheet, at this point it could be reeled up on a core, but as soon as it became dried, it would turn into fluff and no longer form anything but a mass of fibers. This is particularly true of 100% synthetic webs of non-fibrillatable fibers which are especially tender and which, before the application of the primary binder, are held together only by the water menisci.

Preferably, the binder is applied throughout the web in the form of a high solids content latex (i.e., at least 6% solids) foam. A foam density in the range of between about 25 to 150 grams per liter appears to be satisfactory for the binder and it can be applied using known equipment such as the foam distributor header disclosed in U.S. Pat. No. 3,722,469.

The precise latex formulation used on any given sheet depends principally on the drape, hand and other desired characteristics of the final sheet material. Some are softer than others and some tend to make a stiffer sheet. The general characteristics of foamable latices available for non-wovens are known and can be easily chosen with the desired characteristics. As long as it has the required high solids content and is applied throughout the web in the foam density range specified above, it should hold the web together satisfactorily. Later, after the web is dried, the web can be subjected to further bonding or other treatments to modify its characteristics further, if desired.

Examples of the manufacture of non-woven webs using the method according to this invention and of impregnating the web with a primary latex binder are as follows:

EXAMPLE I

A 2% consistency 70% synthetic 30% natural fiber aqueous fiber dispersion was prepared by vigorously agitating 3200 gallons of 80° F. water having a pH of about 7 in a pulper of the type previously described herein to produce tumbling vortex-free water surface conditions. To this agitated water was added 1½ gallons of N-cyclohexyl-N-Palmitoyl-Taurine wetting agent solution, having the formula $$C_{15}H_{31}-\overset{\overset{\displaystyle O}{\|}}{C}-\overset{\overset{\displaystyle C_6H_{11}}{|}}{N}-CH_2-CH_2SO_3^-Na^+$$

The solution was prepared by dissolving 2 quarts of paste of this wetting agent in a gallon of warm (120° F. water). Thereafter, one gallon of a 100% solution of an alkylaryl polyether alcohol type (octylphenol series) wetting agent dissolved in one gallon of warm (120° F.) water was added to the dispersion during continued agitation of the mixture. Then 374 pounds of ¼ inch 1.5 denier straight round polyethylene terephthalate fibers coated with a water dispersible hydrophilic surface finish were added to the solution along with 80 pounds of Eastern Canadian Bleached Sulfate Alpha Softwood (Solka No. 30 Alpha Hi-Bulk) with an initial freeness of about 740 C.S. and 80 pounds of Eastern Canadian Bleached Sulphite Hardwood (Hawkesbury Hardwood Sulphite) with an initial freeness of about 620 C.S.

The mixture was then continuously agitated in the pulper under tumbling vortex-free surface conditions for about 20 minutes to disperse the fibers. Thereafter, while still under agitation, 15 gallons of a 1% solution of long chain polyacrylamide having about 30% hydrolysis was added to the mixture and the entire dispersion transferred to a dump chest using an open impeller pump. There the dispersion continued to be agitated with enough force to maintain the water/air emulsion without the generation of any substantial amount of surface foam. The pulper was then rinsed and the rinse water transferred into the dump chest to reduce the consistency of the dispersion to about 1.75% based on the dry weight of the fibers. From the dump chest the fiber dispersion was passed through a Nichols precleaner to clean the fibers of any metal or other unwanted foreign material. Following this the dispersion was passed through a conventional deflaker where any remaining fiber bundles were separated into individual fibers without hydrating them, into a synthetic fiber mixing chest.

In the synthetic fiber mixing chest the consistency of the dispersion was reduced to about 0.75% by the addition of 80° F. water containing 4 additional gallons of a dilute N-cyclohexyl-N-Palmitoyl-Taurine wetting agent (having the formula $$C_{15}H_{31}-\overset{\overset{\displaystyle O}{\|}}{C}-\overset{\overset{\displaystyle C_6H_{11}}{|}}{N}-CH_2-CH_2SO_3^-Na^+$$

solution prepared by dissolving four quarts of wetting agent paste in four gallons of warm (120° F.) water.

The contents of the synthetic fiber chest was then transferred to a machine chest where the dispersion continued to be agitated under tumbling vortex-free surface conditions. From the machine chest the dispersion was fed into a moving stream of an 80° F. white water air emulsion in which it was uniformly dispersed by turbulence to a consistency of about 0.01%.

The white water/air emulsion was prepared by dissolving a 100% solution of an alkylaryl polyether alcohol (octylphenol series) wetting agent at the rate of about 2 gallons for every 25,000 gallons of 80° F. water having a pH of about 7 to reduce its surface tension to between about 30–35 dynes and circulating the water through the inclined wire non-woven web forming equipment disclosed in U.S. Pat. No. 3,764,465 under agitated conditions to entrain air in the system and create the emulsion.

The dilute suspension of fibers was then deposited on the inclined forming wire and the web consolidated by removing the water through suction boxes. A web was continuously formed containing about 80% moisture based on the bone dry weight of the fibers. From the wire the web was transferred to a conventional non-woven wet press where it was further consolidated and its moisture reduced to about 65%. Then it was passed through a primary binder application station where a high solids (22% solids) acrylic latex foam having a density of about 85 grams per liter was applied to the sheet at the rate of about 6 pounds of latex to 24 pounds of fibers per 3,000 sq. ft. of base web, using equipment disclosed in U.S. Pat. No. 3,722,469. From there the web was dried and reeled up in a manner which is conventional in the wet-laid manufacture of non-woven webs.

EXAMPLE II

About a 1% consistency 70% synthetic 30% natural wood aqueous fiber dispersion was prepared by vigorously agitating 700 gallons of 80° F. water having a pH of about 7 in a side entry impeller stock preparation tank of the type previously described herein to produce tumbling vortex-free water surface conditions. To this agitated water was added 3700 grams of a 100% solution of an alkylaryl polyether alcohol wetting agent (octylphenol series) diluted in 3 gallons of 120° F. water, 720 grams of concentrated sulphuric acid and 36 pounds of a 1% solution of deacetylated polysaccharide (i.e., Ropy Karaya Gum). Then 18.75 pounds of a pre-slurried non-hydrated Eastern Canadian Bleached Sulphite Hardwood pulp based on the bone dry weight of the fibers and having a freeness of about 620 (C.S.) was added to the dispersion followed by the further addition of 43.75 pounds (bone dry weight) of 1.5 denier ¼ inch straight round polyethylene terephthalate fibers having a water dispersible finish on them. The water level in the tank was then increased to 1,500 gallons, maintained at about 80° F. and the entire mixture agitated vigorously enough to create tumbling vortex-free surface conditions for about 15 minutes. Thereafter the stock was transferred to a machine chest in which the agitation of the fiber dispersion was continued at a lower level, but with enough force to maintain the water/air emulsion created in the stock preparation tank.

While this dispersion was being prepared, a white water solution was also prepared by agitating a 3,000 gallon white water system having a temperature of about 80° F. and a pH of about 7 by circulating it through the forming wire of a non-woven web forming machine and thereafter adding to the solution 36 liters of a 1% solution of deacetylated polysaccharide. In addition, 1,800 grams of alkylaryl polyether alcohol wetting agent of the octylphenol series was dissolved in 3 gallons of warm (about 120° F.) water and the resulting solution added to the circulating white water system.

Thereafter, the fiber dispersion was reduced to a consistency of about 0.01% based on the bone dry weight of the fibers by adding it at a predetermined rate to the circulating white water system which transported the now dilute suspension under agitated conditions which maintained the water/air emulsion to the headbox of the forming machine where the fibers were laid down on a moving wire and formed into a web.

As the web came off the wire it was passed through a wet press which reduced the moisture of the sheet to about 65%, based on the bone dry weight of the fibers. From there it was passed to a primary binder application station where a high solids acrylic latex foam was applied to the web at the rate of about 6 pounds per latex to 24 pounds per 3,000 sq. ft. of base web material. The binder was formed by blending 10 gallons of high solids (45% solids) latex emulsion with 100 grams of alkylaryl polyether alcohol wetting agent (octylphenyl series) and water to a total of 20 gallons. The mixture was then pumped through a conventional foaming device and applied to the web. The web was then dried in accordance with the steps of Example I.

EXAMPLE III

The process followed was that of Example II except that the following all-polyester fibers were used instead of a mixture of synthetic and short natural fibers as in the previous examples:

1. 18.75 pounds of 6 denier ½ inch straight round polyethylene terephthalate fibers,
2. 18.75 pounds of 1.5 denier ¼ inch crimped polyethylene terephthalate fibers, and
3. 25 pounds of 1.5 denier ¼ inch straight round polyethylene terephthalate fibers.

All of these fibers were coated with a water dispersible hydrophilic surface coating as purchased from the manufacturer. At the binder application station, 11 gallons of a polyester latex emulsion with 750 grams of alkylaryl polyether alcohol wetting agent (octylphenol series) and water to a total of 20 gallons and the mixture pumped through a foaming device and applied to the web at a density of about 85 grams per liter at a rate of about 6 pounds of latex to 24 pounds of fibers per 3,000 sq. ft. of base web.

EXAMPLE IV

The process followed was the same as that described in Example II, but a 100% synthetic 70% polyester 30% Nylon web was formed from 18.75 pounds of 3 denier, 0.030 inch Nylon flock fibers, and 44 pounds of 1.5 denier, ¼ inch straight round polyethylene terephthalate fibers. Also, the web was treated with a 18% solids acrylic latex foam binder having a density of about 85 grams per liter and at a rate of about 6 pounds of latex to 24 pounds of fibers per 3,000 sq. ft. of base web.

EXAMPLE V

A 1% consistency aqueous 100% rayon fiber dispersion was prepared by vigorously agitating 12,000 gallons of 80° F. water having a pH of about 7 in the side entry impeller synthetic fiber mixing chest of Example I to create tumbling vortex-free water surface conditions. To this was added the following:

1. 600 pounds of 1.5 denier, ¼ inch straight round viscose rayon fibers;
2. 200 pounds of 3.0 denier, ½ inch straight round viscose rayon fibers; and 3. 200 pounds of 5.5 denier, ¾ inch straight round viscose rayon fibers.

Thereafter, a solution of 1 gallon of a 100% solution of an alkylaryl polyether alcohol type (octylphenol series) wetting agent diluted in 4 gallons of warm (120° F.) water and 1 ½ quarts of an optical brightener was added to the dispersion. Vigorous agitation was applied to this mixture creating tumbling vortex-free water surface conditions for about 20 minutes, followng which 25 gallons of a 1% solution of the long chain polyacrylamide of Example I was added and mixed in. Then while still under sufficient agitation to maintain the water/air emulsion the fiber dispersion was transferred to the machine chest of Example I and mixed with the white water/air emulsion which carried the fibers to the headbox where the web was formed. The white water/air emulsion was prepared as in Example I by adding about 2 quarts of an alkylaryl polyether alcohol type (octylphenol series) wetting agent dissolved in warm (120° F.) water at the rate of about 4 gallons for every 25,000 gallons of 80° F. water having a pH of about 7 and by circulating the solution through the system. After formation the web was passed through a wet press as in Example I and treated with a 22% solids acrylic latex foam binder having a density of about 85 grams per liter. The foam was applied at a rate of about 6 pounds of binder to 28 pounds of fiber per 3,000 sq. ft. of base web to form a prebonded 1.6 oz/sq. yd. web for subsequent treatment.

In all these examples and in handling the initial fiber dispersion according to this process, it is important to prevent the emulsion from cascading as it is transferred from one tank or one place to another. Thus gravity flow down into an empty tank is likely to cascade and create foam which will float fibers out of the dispersion. To avoid such an occurrence, it is advisable to use tanks in which the dispersion enters from the bottom instead of from the top. In this way, cascading is avoided and the water/air emulsion can be maintained.

As indicated in the Examples, one advantage of the invention is that it enables an essentially 100% binder free man made non-fibrillatable round or non-flat surfaced fiber sheet to be formed and transferred from a forming wire without tearing or pulling apart. Further, the furnish from which such sheets are made can even include crimped fibers.

Moreover, though not indicated in the examples, where hydrophobic fibers ¾ inches or longer are used in the fiber furnish, they may be added to the dispersion while it is undergoing a less vigorous agitation than in the initial dispersion of the shorter fibers. A conventional side entry impeller synthetic fiber mixing tank or chest is generally adequate for this purpose. In addition, there appears to be some advantage in adding such fibers at this stage, because it is believed that the shorter fibers in the dispersion together with the air bubbles help to disperse the longer fibers.

It will therefore be appreciated that the process according to this invention involves a significant step forward in the art of forming non-woven sheet materials.

What is claimed is:

1. The method of uniformly dispersing selected non-fibrillated fibers in a substantially binder free aqueous medium, a majority of the fibers being man made nonfibrillatable hydrophobic fibers of not less than about ¼ inch in length and with a length to diameter ratio of between about 400:1 to about 700:1 including the steps of combining: water, a sufficient amount of the selected fibers for a dispersion having a fiber consistency of between about 0.35% to about 2% based on the bone dry weight of the fibers, and between about 0.007% to about 0.03% by weight of a wetting agent consisting of a selected combination of alkylaryl polyether alcohol (octylphenol series) and N-cyclohexyl-N-Palmitoyl-Taurine having the formula $$C_{15}H_{31}-\overset{\overset{\displaystyle O}{\|}}{C}-\overset{\overset{\displaystyle C_6H_{11}}{|}}{N}-CH_2-CH_2SO_3^-Na^+$$

in a container to reduce the surface tension of the water to between about 30–35 dynes, and vigorously agitating the mixture in the container in the presence of air to create the tumbling vortex-free water surface conditions without the generation of any substantial amount of surface foam, thereby generating a steady state water/air emulsion in which the fibers are uniformly dispersed and in which the volume of air does not exceed about 4% of the volume of the water.

2. The process according to claim 1 wherein between about 0.0009% and 0.006% by weight of long chain polyacrylamide having a molecular weight of at least about 750,000 to about 6,000,000 is added to the mixture to help stabilize the dispersion.

3. The process according to claim 1 wherein the volume of air in the emulsion is between about 2% to not in excess of about 4% of the volume of the water.

4. The process according to claim 2 wherein the volume of air in the emulsion is between about 2% to not in excess of about 4% of the volume of the water.

5. The method of producing a textile-like nonwoven sheet material on a wet-laying web forming wire characterized by forming a uniform initial high fiber consistency dispersion in a water/air emulsion according to claim 1 and thereafter diluting the dispersion to a uniform fiber consistency of between about 0.006% to about 0.01% based on the bone dry weight of the fibers by mixing the initial dispersion with a steady state water/air dilution emulsion in which the volume of air does not exceed about 4% of the volume of the water; which emulsion has been created by reducing the surface tension of the dilution water to between about 30–35 dynes by the addition to it of between about 0.007% to about 0.03% by weight of a wetting agent consisting of a selected combination of alkalaryl polyether alcohol (octylphenol series) and N-cyclohexyl-N-Palmitoyl-Taurine having the formula $$C_{15}H_{31}-\overset{\overset{\displaystyle O}{\|}}{C}-\overset{\overset{\displaystyle C_6H_{11}}{|}}{N}-CH_2-CH_2SO_3^-Na^+$$

and by vigorously agitating the dilution water with this wetting agent in it in the presence of air to create the water/air dilution emulsion without the generation of any substantial amount of surface foam; and then draining the non-fiber portion of the diluted fiber dispersion through the web forming wire to form the material.

6. The method of forming a textile-like nonwoven sheet material on a wet-laying web forming wire characterized by forming a uniform initial high fiber consistency dispersion in a water/air emulsion according to claim 2 and thereafter diluting the dispersion to a uniform fiber consistency of between about 0.006% to about 0.01% based on the bone dry weight of the fibers by mixing the initial dispersion with a steady state water/air dilution emulsion in which the volume of air does not exceed about 4% of the volume of the water; which emulsion has been created by reducing the surface tension of the dilution water to between about 30–35 dynes by the addition to it of between about 0.007% to about 0.03% by weight of a wetting agent consisting of a selected combination of alkalaryl polyether alcohol (octylphenol series) and N-cyclohexyl-N-Palmitoyl-Taurine having the formula

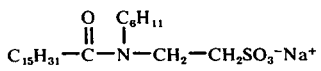

and by vigorously agitating the dilution water with this wetting agent in it in the presence of air to create the water/air dilution emulsion without the generation of any substantial amount of surface foam; and then draining the non-fiber portion of the diluted dispersion through the web forming wire to form the material.

7. The method according to claim 5 in which between about 0.0009% and 0.006% by weight of long chain polyacrylamide having a molecular weight of between at least about 750,000 to about 6,000,000 is included in the steady state dilution water/air emulsion before the initial dispersion is diluted in it.

8. The method according to claim 6 in which between about 0.0009% and 0.006% by weight of long chain polyacrylamide having a molecular weight of between at least about 750,000 to about 6,000,000 is included in the steady state dilution water/air emulsion before the initial dispersion is diluted in it.

9. The process according to claim 7 wherein the volume of air in the dilution emulsion is between about 2% to not in excess of about 4% of the volume of the dilution water.

10. The process according to claim 8 wherein the volume of air in the dilution emulsion is between about 2% to not in excess of about 4% of the volume of the dilution water.

11. The method of uniformly dispersing selected non-fibrillated fibers in a substantially binder free medium, a majority of the fibers being man made non-fibrillatable hydrophobic fibers of not less than about ¼% in length and with a length to diameter ratio of between about 400:1 to about 700:1 including the steps of combining water, with a selected amount of a wetting agent consisting of N-cyclohexyl-N-Palmitoyl-Taurine having the formula

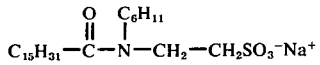

in a container and vigorously agitating the two in the presence of air to create tumbling vortex-free water surface conditions, thereafter, while continuing the agitation, adding a predetermined quantity of alkylaryl polyether alcohol (octylphenol series) wetting agent during continued agitation of the medium, to reduce the water's surface tension to between about 30–35 dynes, to generate a water/air emulsion without any substantial amount of surface foam and in which the volume of air is less than about 4% that of the water, the total wetting agent being between about 0.007% to about 0.03% by weight of the water, followed by adding a sufficient amount of the fibers to the medium for a dispersion having a fiber consistency of between about 0.35% to about 2% based on the bone dry weight of the fibers, continuing to maintain the tumbling vortex-free water surface conditions until the fibers are uniformly dispersed in the water/air emulsion at the desired consistency and thereafter adding to the dispersion between about 0.0009% and about 0.06% by weight of long chain polyacrylamide having a molecular weight of at least 750,000 to about 6,000,000 to help stabilize the dispersion.

12. The process according to claim 5 without using binders or adhesives wherein after web formation water is withdrawn from the web to a residual moisture content of about 82% to 78% based on the bone dry weight of the fibers and the web with this moisture content is continuously removed from the forming wire without tearing or falling apart.

13. The process according to claim 12 wherein the man made non-fibrillatable fibers in the web are lacking in smooth flat surfaces.

14. The process according to claim 12 wherein the man made fibers in the web comprise substantially round man made non-fibrillatable fibers.

15. The process according to claim 14 wherein after removal of the web from the forming wire, the web is consolidated and more water is removed leaving a residual moisture in the web of between about 60% and 70% based on the bone dry weight of the fibers, and thereafter a primary binder is applied to the web in the form of a latex foam having a density of between about 20 and 150 grams per liter and the latex portion of the foam has a solids content of at least about 6%.

* * * * *

UNITED STATES PATENT AND TRADEMARK OFFICE

CERTIFICATE OF CORRECTION

PATENT NO. : 4,007,083

DATED : February 8, 1977

INVENTOR(S) : Michael Ring, Madhu P. Godsay, Roy S. Swenson, Joseph N. Kent

It is certified that error appears in the above-identified patent and that said Letters Patent are hereby corrected as shown below:

Abstract, line 14 - "meof" should be -- me of --

Col. 3, line 10 - "wetlaid" should be -- wet-laid --

Col. 3, line 42 - "nonfi" should be -- non-fi- --

Col. 14, line 17 - after "create" delete "the"

Col. 16, line 25 - "0.06%" should be -- 0.006% --

Signed and Sealed this

Fourteenth Day of June 1977

[SEAL]

*Attest:*

RUTH C. MASON
*Attesting Officer*

C. MARSHALL DANN
*Commissioner of Patents and Trademarks*